United States Patent [19]

Hout

[11] 3,967,231

[45] June 29, 1976

[54] VARIABLE RESISTOR WITH PLUG-IN RESISTANCE ELEMENT

[76] Inventor: Chester L. Hout, Box 235, Atlanta, Ill. 61723

[22] Filed: Mar. 31, 1975

[21] Appl. No.: 563,805

[52] U.S. Cl. ..... 338/117; 338/150

[51] Int. Cl.[2] ..... H01C 10/26

[58] Field of Search ..... 338/117, 150, 151, 152, 338/76, 166

[56] References Cited

UNITED STATES PATENTS

| | | | |
|---|---|---|---|
| 544,047 | 8/1895 | Meissner | 338/117 |
| 586,622 | 7/1897 | Porter | 338/117 X |
| 1,216,756 | 2/1917 | Williams | 338/117 |
| 1,536,321 | 5/1925 | Amsler | 338/117 |
| 2,398,758 | 4/1946 | Miller | 338/117 |
| 2,860,214 | 11/1958 | Bourns | 338/117 |
| 2,898,568 | 4/1959 | Bourns et al. | 338/117 |

*Primary Examiner*—J. V. Truhe
*Assistant Examiner*—David A. Tone
*Attorney, Agent, or Firm*—Lockwood, Dewey, Zickert & Alex

[57] ABSTRACT

An improved variable resistor wherein the resistance element therein is readily removable for repair or replacement through the front of the resistor without otherwise dismantling it. The resistance element is carried on a control shaft which is rotatably journaled and releasably axially retained in the resistor. The resistance as carried on the shaft extends no further radially outward from the outer surface of the shaft than an amount sufficient to provide a proper electrical contact and yet allow the shaft to be axially removable through a journal at the front of the resistor. The resistance element may then be repaired or replaced without disconnecting leads to the resistor or further dismantling it or any framework in which it may be mounted.

8 Claims, 6 Drawing Figures

VARIABLE RESISTOR WITH PLUG-IN RESISTANCE ELEMENT

This invention relates generally to variable resistors and more particularly to a variable resistor including a resistance element therein which is selectively removable through the front of the resistor eliminating the necessity of dismantling same, removing the device from a chassis to which it may be mounted, or separating the resistor from the electrical connections to which it may be attached, in order to repair it.

Variable resistors or potentiometers are used in an electrical device to vary an output therefrom such as a volume control in a television or radio, rheostat in an electric heater, light dimmer control, or the like. Variable resistors commonly include a body with a resistance element and electrical contacts therein with at least one contact touching the resistor element variably along its length, and a rotatable control shaft extending outwardly from the body which may have a remote drive means such as a pulley or a finger adjustment means such as a knob attached thereto. The turning of the knob commonly moves the contact relative the resistor element varying the resistance across the contacts. A variable resistor is commonly mounted in a framework such as the chassis of a television so that the body is mounted to the inside of an external panel with the rotatable shaft protruding through the panel to its exterior for finger manipulation.

The advance of the state of the art in variable resistors coupled with high labor costs and a miniaturization wave throughout the electronic industry, have actually created problems for the electrical product service industry. For example, in many instances it is more expensive to dismantle a modern television with miniature components in order to remove and replace a volume control, than it was to remove, repair and reinstall such a control in prior art televisions. Also, a common problem with existing variable resistors is a defective resistance element. While the remainder of the resistor may function properly, it may have to be discarded because many modern variable resistors are structured to be non-repairable.

Applicant's invention solves the above problems by providing a variable resistor which can be repaired by removing the resistance element through the front of the resistor thus eliminating the need to dismantle either its body or the appliance, instrument or the like in which it is mounted. A variable resistor of the invention constitutes a resistance element, a body housing the resistance element, a first contact means contiguous with the resistance element and a second contact means contiguous with the resistance element variably along its length. A shaft journaled in and extending from the body is rotatable for varying the position of the second contact means relative the length of the resistance element.

The improvement provided by the present invention is the device described above wherein the resistance element is mounted on the shaft, and the shaft including the resistance element is readily removable from the body through the journal for repair or replacement.

It is therefore an object of the invention to provide an improved variable resistor constructed so as to be much easier to service then existing variable resistors.

Another object of the invention is to provide a variable resistor which can be repaired without dismantling it and without dismantling a framework in which the resistor may be mounted.

A further object of the invention is the provision of a variable resistor including a rotatable shaft and which has a resistance element mounted thereon and which is readily removable therefrom for facilitating repair or replacement of same.

Other objects, features and advantages of the invention will be apparent from the following detailed disclosure taken in conjunction with the accompanying drawings, wherein like reference numerals refer to like parts in which.

Figure 1:
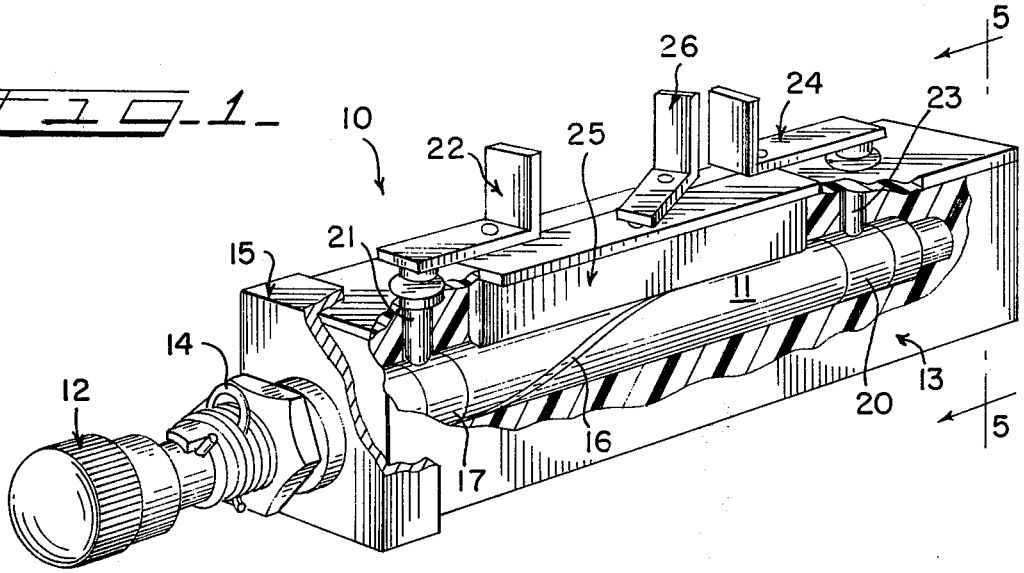
FIG. 1 is a front perspective view, partially broken away, of a variable resistor forming one embodiment of the invention.

Turning to FIG. 1, the variable resistor of the invention is generally indicated at 10. Variable resistor 10 includes a shaft 11 including a control knob 12 at one end and journaled in a body 13 along the major portion of its length. Shaft 11 is made of a dielectric material and is readily removable from body 13. A retaining means in the form of a spring clip 14 is engaged with shaft 11 and end cap 15 positioned at the front end of body 13 preventing axial movement therebetween.

Body 13 houses the major portion of the variable resistor 10. Shaft 11 is rotatably mounted in body 13 and includes a resistance element 16 of known resistance which is spirally embedded in the outer surface of shaft 11. Mounted around shaft 11 at either end of resistance element 16 are electrically conductive collector rings 17, 20 which provide continuous electrical current flow capability for resistance element 16 through front contact 21 and terminal strip 22 at collector ring 17, and through rear contact 23 and terminal strip 24 at collector ring 20. While terminal strips 22, 24 may be connected to leads from an electrical circuit, the resistance between the two would be constant. Therefore, as installed in a circuit, one of terminal strips 22 or 24 is connected with resistance element 16 through contact bar 25 and terminal strip 26. Contact bar 25 is elongated, axially oriented with shaft 11 and contiguous at a limited area along its length with the crest portion of the resistance element 16. As shaft 11 is rotated in body 13, the contact area between contact bar 25 and resisor element 16 varies in position along the length of the element changing the ohm resistance value between terminal 26 and either of terminal strips 22 and 24 thereby providing the variable resistance function of the device.

Figures 2, 5, 6:
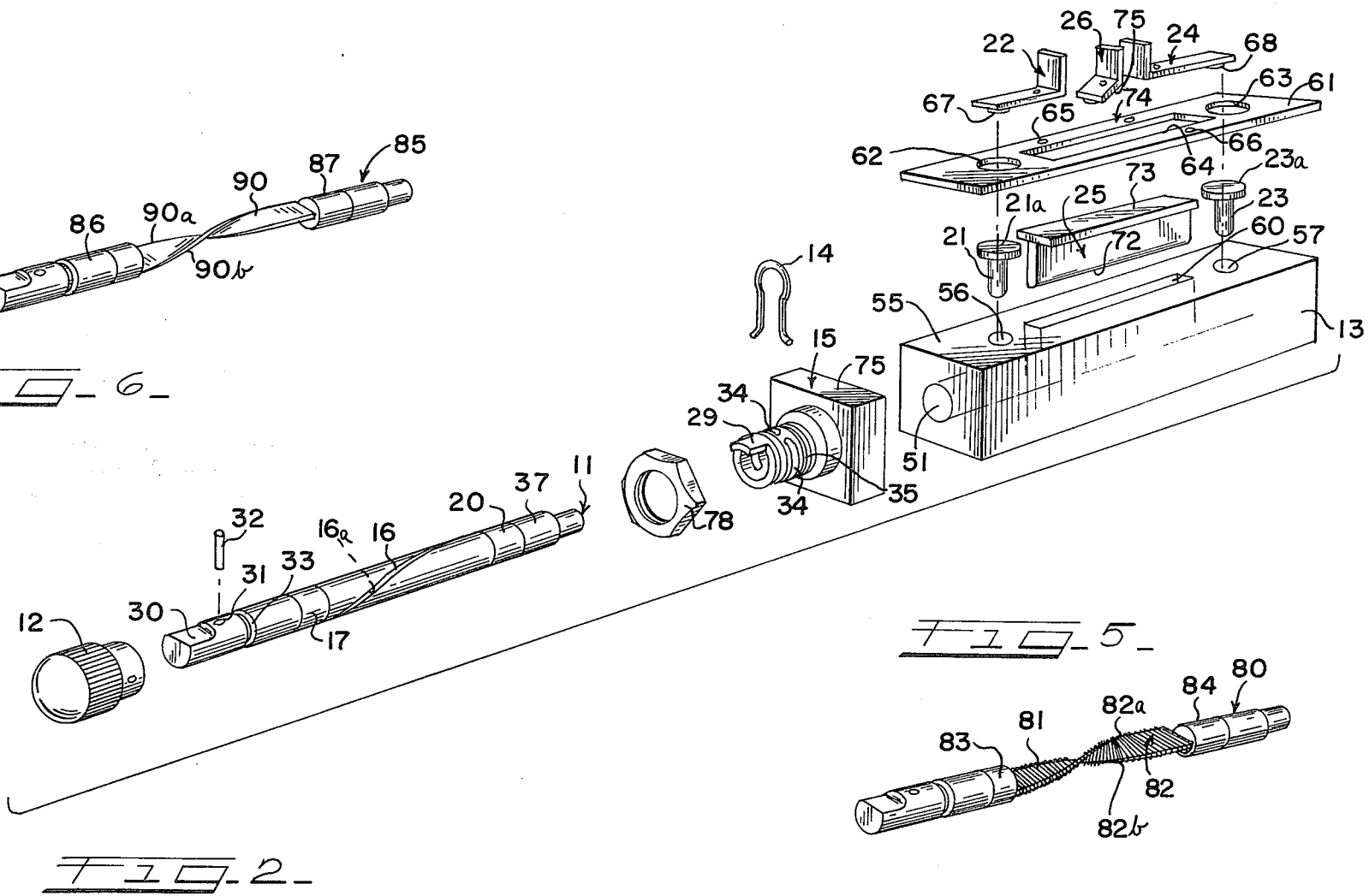
FIG. 2 is an exploded perspective view of the variable resistor of the invention.
FIG. 5 is a perspective view of a modification of the rotating shaft for the resistor which includes an element of differing resistance from the rotatable shaft as shown in FIG. 2.
FIG. 6 is a perspective view of a second modification of the rotatable shaft including a resistance element differing from either of those shown in FIG. 2 and FIG. 5.

Referring to FIG. 2 shaft 11 is shown including a control knob receiving portion 30 which may be notched, splined, or the like to receive control knob 12 in fixed rotational and axial orientation thereon. Inwardly from the control knob receiving portion 30 on shaft 11 is a hole 31 extending inward and part way through the shaft for receiving a pin 32 which engages either side of a tab 29 extending from the distal end of end cap 15 thus limiting the rotation of shaft 11 in housing 13 to approximately somewhat less than one full turn. Adjacent hole 31 is a circumferential groove 33 which is alignable with a pair of substantially semicircular apertures 34—34 in a threaded sleeve portion 35 of end cap 15 to receive the locking spring clip 14. Clip 14 is removably inserted into apertures 34—34 and groove 33 to restrain the axial movement of shaft 11 in body 13 while allowing rotational movement therebetween. Along the remainder of shaft 11 are the front and rear collector rings 17, 20 with resistance element 16 in between. The outer surfaces of collector rings 17, 20 are approximately flush with the outer surface of shaft 11. Resistor element 16 is preferably positioned in a spiral groove 16a in shaft 11 and the elements outer surface crests outward of the shaft outer surface to provide sufficient contact with contact bar 25. A bearing surface 37 is preferably positioned at the rear of shaft 11. While the diameter of shaft 11 may vary across its length, in a preferred embodiment its outer diameter will not be larger than that portion adjacent groove 33 which is journaled in end cap 15 thus allowing the removal of the shaft through the front of the variable resistor device 10.

Figure 3:
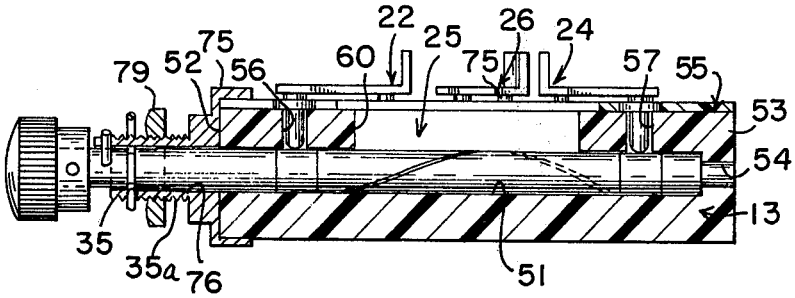
FIG. 3 is a cross-sectional view of the device taken substantially along line 3—3 of FIG. 1 with the rotatable shaft thereof shown in elevation.
Figure 4:
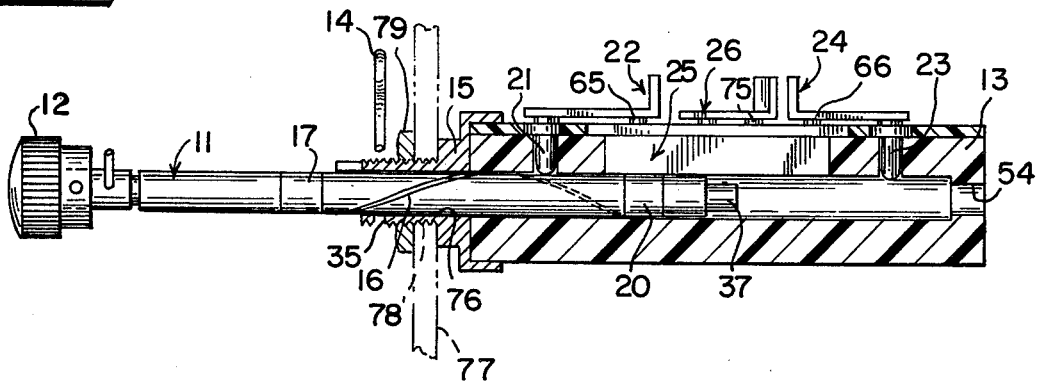
FIG. 4 is a cross-sectional view similar to that of FIG. 3 wherein the rotatable shaft including the resistance element thereon is partially removed from the body of the resistor according to the invention.

Excepting for the projecting portion of shaft 11 and end 15, the entire variable resistor 10 is mounted in the body 13, shown most clearly in FIGS. 2 and 3. The body 13 of this embodiment is generally elongated and rectangular in form. However, any equivalent housing capable of mounting the shaft 11 and the various contact structures therein is sufficient. Body 13 includes a generally cylindrical aperture 51 substantially longitudinal therethrough. Aperture 51 is of sufficient diameter to allow the rotatable mounting of shaft 11 therein and to allow its removal through the front 52 of the body as shown in FIGS. 3 and 4. Body 13 preferably includes a bearing portion 54 adjacent its rear end 53 in which the bearing surface 37 of shaft 11 is rotatably received for axial stability.

A pair of generally cylindrical contact receiving apertures 56, 57 in body 13 are oriented perpendicular to and in communication with central aperture 51 and top body surface 55. Also, an elongated rectangular contact bar receiving aperture 60 is positioned in between the front and rear cylindrical contact apertures 56, 57 and is axially aligned and in communication with both central aperture 51 and top body surface 55. In this embodiment a top plate 61 having rectangular outer dimensions equal to that of body top surface 55 is mounted thereon and contains cylindrical contact apertures 62, 63 and a rectangular contact bar aperture 64 which are aligned with and preferably larger than the respective contact apertures 56, 57 and contact bar aperture 60 in body 13. It should be noted that top plate 61 may be integrated into one piece with housing 13 if desired.

Removable electrical contacts 21, 23 are positioned in the front and rear contact receiving apertures 56, 57 with their distal ends in contact with the front and rear collector rings 17, 20, respectively. Their enlarged headed ends 21a, 22a (FIG. 2) are positioned in top plate apertures 62, 63, respectively, and retained from downward movement into aperture 51 by top body surface 55. Terminal strips 22, 24 are made of resilient electrically conductive material and are mounted on top cover 61 at 65, 66 respectively such that contact buttons 67, 68 thereon are biased in contact with the heads of contacts 21, 23 respectively. The vertical leg end of each terminal strip 22, 24 serves as a terminal to which an electrical lead (not shown) may be connected in known manner. It should be noted that the contacts 21, 22 and terminal strips 22, 24 can be made integral if desired.

Contact bar 25 is elongated and is received in contact bar receiving aperture 60 such that its lower distal contact edge 72 is contiguous with a portion of resistance element 16 which varies along its length as shaft 11 is turned in body 13. An upper horizontal enlarged head portion 73 of contact bar 25 is received in enlarged contact bar receiving aperture 64 in top cover 61 and retained from downward movement by body top surface 55. Contact bar terminal strip 26 is made of resilient electrically conductive material and is mounted to top plate 61 at 74 such that contact button 75 is biased in contact with contact bar top surface 73. The vertical leg end of terminal strip 26 is a terminal to which the second electrical lead (not shown) of a circuit may be connected in known manner.

As shown in FIGS. 1 through 4, an end cap 15 is mounted to body 13 and includes a mounting portion 75 and a sleeve portion 35. The mounting portion 75 engages the front end 55 of body 13 and is retained by mechanical engagement or suitable bonding means. Sleeve portion 35 also includes an aperture 76 centrally therethrough in which shaft 11 is journaled as shown most clearly in FIG. 3. The outer surface of sleeve 35 is threaded at 35a. Typically, the variable resistor 10 is mounted in an electrical device such as a television with its body inside the television chassis, shown in outline at 77 in FIG. 4. Sleeve 35 and shaft 11 are inserted through an aperture 78 in chassis 77. A mounting nut 79 is then threaded onto the treads **35*a* of sleeve 35 to retain the resistor in the chassis. Finally, control knob 12 is inserted onto the knob receiving portion 30 of shaft 11. It should be noted that end cap 15 may be made integral with body 13** within the scope of the invention.

In FIG. 4 shaft 11 is shown being withdrawn from the body 13 through the end cap journal aperture 76. The spring clip 14 is easily removed from apertures 34—34 in sleeve 35 and groove 33 in shaft 11 to allow the axial movement of the shaft through journal aperture 76. The mounting nut 79 and, more importantly, the terminal strips 22 or 24 and 26 need not be disconnected in order to repair or replace the resistance element 16. Secondly, since the terminals are not disconnected, the chassis need not be dismantled either.

Also, the resistance of the device 10 may be changed by inserting the modified shafts shown at 80 and 85 respectively, in FIGS. 5 and 6.

In shaft 11, the resistance element 16 is of a mediate level as measured in ohms. In the modification shown in FIG. 5 a shaft is indicated generally at 80 having a fine wire resistance element 81 wound around a spirally formed insulator 82 positioned between collector rings 83, 84. Element 81 provides a high ohm resistance level and the spiral insulator 82 provides a structure such that only its opposing outer edges **82*a*–82*b* may be contiguous with contact bar 25. In other respects, shaft 80 is identical with shaft 11.**

A second modification of the rotatable shaft is shown at 85 in FIG. 6. As in the first modification, only that portion of the shaft between the collector rings 86, 87 is altered from the construction of shaft 11. The resistance element 90 positioned between collector rings 86, 87 is in a spiral strip form similar in shape to the insulator 82 of the first modification 80. Resistance element 90 has a lower ohm resistance level than the element 16 of shaft 11. Also, the spiral construction of element 90 permits contact with contact bar 25 only along the outer edges 90*a*, 90*b* of the spirally wound strip. Otherwise, the structure of shaft 95 is identical with the structure of shafts 11 and 80.

It should also be understood that a push-pull, on-off switch (not shown) can be installed at the rear end of body 13. The switch can be controlled manually by an added shaft (not shown) extending through a central aperture (not shown) axially through rotatable shaft 11.

It will be understood that modifications and variations may be effected without departing from the scope of the novel concepts of the present invention, but it is understood that this application is limited only by the scope of the appended claims.

I claim:

1. In a variable resistor including means providing a resistance element, a body housing said resistance element, first contact means in said body for providing an electrically conductive contact with said resistance element at a constant position along its length, second contact means in said body for providing an electrically conductive contact with said resistance element at a variable position of contact along its length, a shaft means journaled in said body with one end being accessible from the exterior thereof and which is rotatable from said accessible end for varying the relative position of contact of said second contact means along said resistance element, the improvement wherein;

said resistance element is mounted on said shaft means, and said shaft means including said resistance element is readily removable from said body without dismantling same.

2. The variable resistor called for in claim 1 wherein said resistance element means includes a contact surface forming a spiral around the axis of said shaft means, said contact surface being proximately aligned with the outer surface of said shaft means.

3. The variable resistor called for in claim 2 wherein said resistance element means contact surfaces crest outwardly of the outer surface of said shaft means.

4. The variable resistor called for in claim 2 wherein said first and second contact means are mounted in said body in substantially stationary positions.

5. The variable resistor called for in claim 4 wherein said second contact means is elongate, axially aligned with said shaft means, and adjacent thereto for providing contact between said contact means and said resistance element means variably along the length of each as said shaft means is rotated in said body.

6. The variable resistor called for in claim 5 wherein said shaft means projects from one end of said body.

7. In a variable resistor including a body for housing and providing a mounting for said resistor, said body including an aperture centrally therethrough;

a shaft means rotatably journaled in said aperture;

an elongated resistance element means inside said body;

first contact means positioned contiguously with at least one end of said resistance element means for connecting said resistor to one lead of an electrical circuit;

second contact means contiguous with said resistance element variably along its length for connecting said resistor to the other lead of an electrical circuit;

and the rotation of said shaft determining the position of said second contact means relative said resistance across said first and second contact means;

the improvement wherein said first and second contact means are mounted in substantially stationary position in said body adjacent and axially aligned with said shaft means;

said elongated electrical resistance element means is spirally positioned and axially aligned on said shaft with a contact surface of said element means in proximity with the outer surface of said shaft means; and said contact surface of said resistance element means on said shaft means extends radially outwardly therefrom a distance no greater that the radius of said aperture centrally through said body in which said shaft means is journaled.

8. The variable resistor called for in claim 7 further including means for axially retaining said shaft means in said central body aperture while allowing said shaft means to be rotatable therein, said retaining means being releasable for allowing the removal of said shaft means including said resistance means from said body while said body remains intact.

* * * * *